United States Patent [19]

Solomon

[11] 4,066,401

[45] Jan. 3, 1978

[54] LONG TERM STORAGE APPARATUS

[76] Inventor: Arie Solomon, 5 Anderston St., Ramat-Aviv, Tel-Aviv, Israel

[21] Appl. No.: 681,477

[22] Filed: Apr. 29, 1976

[30] Foreign Application Priority Data

May 5, 1975 Israel ..... 47235

[51] Int. Cl.[2] ..... C23F 15/00; A23L 3/00

[52] U.S. Cl. ..... 21/61; 21/2; 21/2.5 R; 21/2.5 B; 99/467; 206/205; 206/207; 206/317; 206/508; 206/524.8; 426/418; 426/419

[58] Field of Search ..... 21/2, 2.5 R, 2.5 B, 21/61; 426/418, 419, 665; 206/205, 207, 213.1, 317, 524.8, 508, 808, 526; 99/467

[56] References Cited

U.S. PATENT DOCUMENTS

| | | | |
|---|---|---|---|
| 1,817,714 | 8/1931 | Shand | 21/2.5 R |
| 2,445,152 | 7/1948 | Poole | 21/2.5 R UX |
| 2,531,550 | 11/1950 | Bradley et al. | 206/317 |
| 2,616,780 | 11/1952 | Atkinson et al. | 21/2.5 R |
| 2,746,684 | 5/1956 | Colvin et al. | 21/2.5 R UX |
| 3,020,121 | 2/1962 | Bull | 21/2.5 B UX |
| 3,084,791 | 4/1963 | Hawley | 206/205 |
| 3,360,382 | 12/1967 | Miller | 206/205 X |
| 3,419,184 | 12/1968 | Asenbauer | 206/508 |
| 3,521,806 | 7/1970 | Esty | 206/205 X |
| 3,627,393 | 12/1971 | Hickson et al. | 206/205 X |
| 3,704,088 | 11/1972 | Nagel et al. | 21/2.5 R |
| 3,759,416 | 9/1973 | Constantine | 206/508 X |

*Primary Examiner*—Barry S. Richman
*Attorney, Agent, or Firm*—Donald M. Sandler

[57] ABSTRACT

A long term storage system comprising:

conduit means for supplying an inert gas;

a plurality of long term storage containers adapted to be filled with an atmosphere of said inert gas and a fluid flow pathway serially interconnecting said conduit means with said long term storage containers for providing a continuous or intermittent supply of said inert gas thereto.

7 Claims, 3 Drawing Figures

Fig. 1
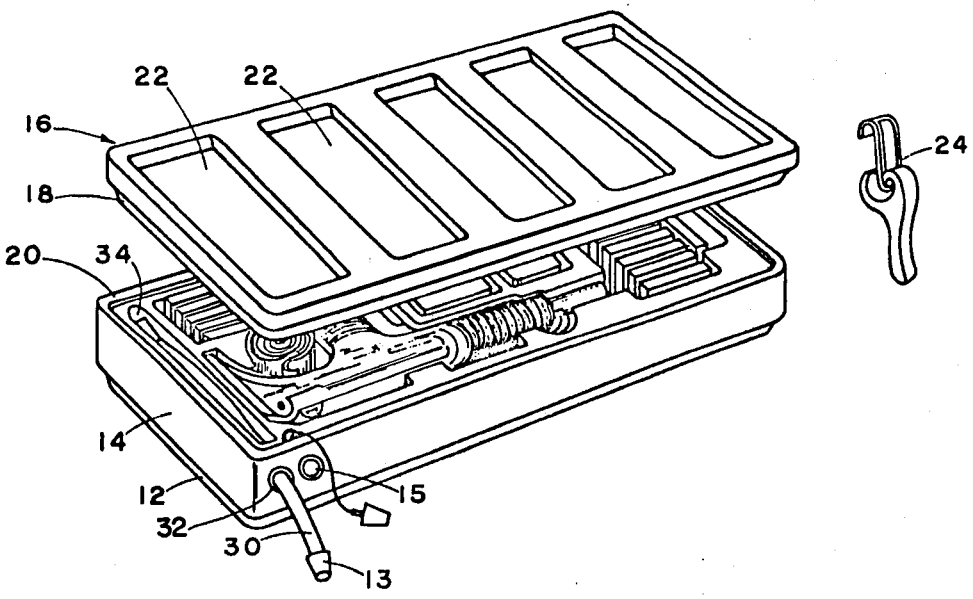
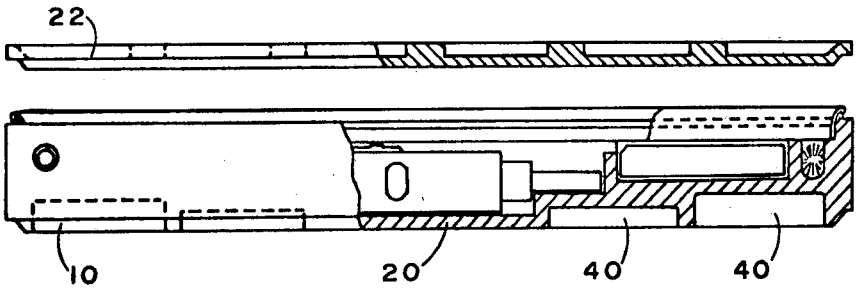
Fig. 2

LONG TERM STORAGE APPARATUS

The present invention relates to storage apparatus and more particularly to apparatus for long term storage of hardware such as guns or machinery or perishable items such as fruit.

In military planning for response to sudden emergency, the time necessary for mobilization of a military vehicle and its crew is a critical factor. Often a military vehicle must be quickly removed from storage and outfitted with the necessary armaments in a very short time. In the past, the time required for removing armaments from storage and fitting them onto a vehicle or providing them to individual soldiers has been unduly lengthened due to the fact that oil or grease in which guns and similar armaments are conventionally stored must first be removed. Removal of the storage oil or grease is a time consuming operation which must usually be done by hand, wasting precious time of a highly trained crew. Other methods of storing ammunition not employing oil, have however not adequately protected the stored material from rust or other corrosion.

Similarly where machinery is stored in grease or oil it is often a costly and time consuming process to prepare articles for use. Applications also may exist where oil or grease contamination of the machinery or of a work piece cannot be tolerated.

It is a purpose of the present invention to overcome the aforesaid deficiencies in the storage of armaments and hardware to provide storage apparatus in which guns and ammunition or different types of hardware may be conveniently stored together in the same container.

It is also a purpose of the present invention to provide a convenient mechanism for long term storage and transport of perishable items such as fruit.

In accordance with the present invention there is provided a long term storage system comprising:

conduit means for supplying an inert gas;

a plurality of long term storage containers adapted to be filled with an atmosphere of said inert gas and a fluid flow pathway interconnecting said conduit means with said long term storage containers for providing a supply of said inert gas thereto.

According to the present invention there is also provided a long-term storage container for use in a storage system comprising:

a container body adapted to contain goods;

a container top adapted when closed to substantially completely seal the interior of said container and the goods contained therein from the outside atmosphere; and means coupled to said conduit means and to the interior of said container for facilitating the provision and maintenance of an inert gas atmosphere in said container.

According to a preferred embodiment of the invention, the interior of the container may be molded to conform to the general configuration of the goods to be stored therein thereby providing substantial protection against damage from accidental impact. The container and its cover conveniently may be formed of hard plastic or metal and may be provided with rubber or other similar seals. The molded interior of the container according to a preferred embodiment of the invention may conveniently be formed of conventional polystyrene foam.

According to a further embodiment of the invention the containers may be designed to be stackable one upon another and configured to have one or more gas access valves disposed on a side of each container as to be accessible when the containers are in stacked disposition.

The containers may be conveniently stacked in a storeroom with their valves interconnected with a continuous supply of hydrogen gas to preserve the inert atmosphere within each container.

The invention will be more fully appreciated and understood when taken in conjunction with the drawings in which:

FIG. 1 is a pictorial view of a preferred embodiment of the invention;

FIG. 2 is a partially cutaway side view of the embodiment shown in FIG. 1.

Figure 3:
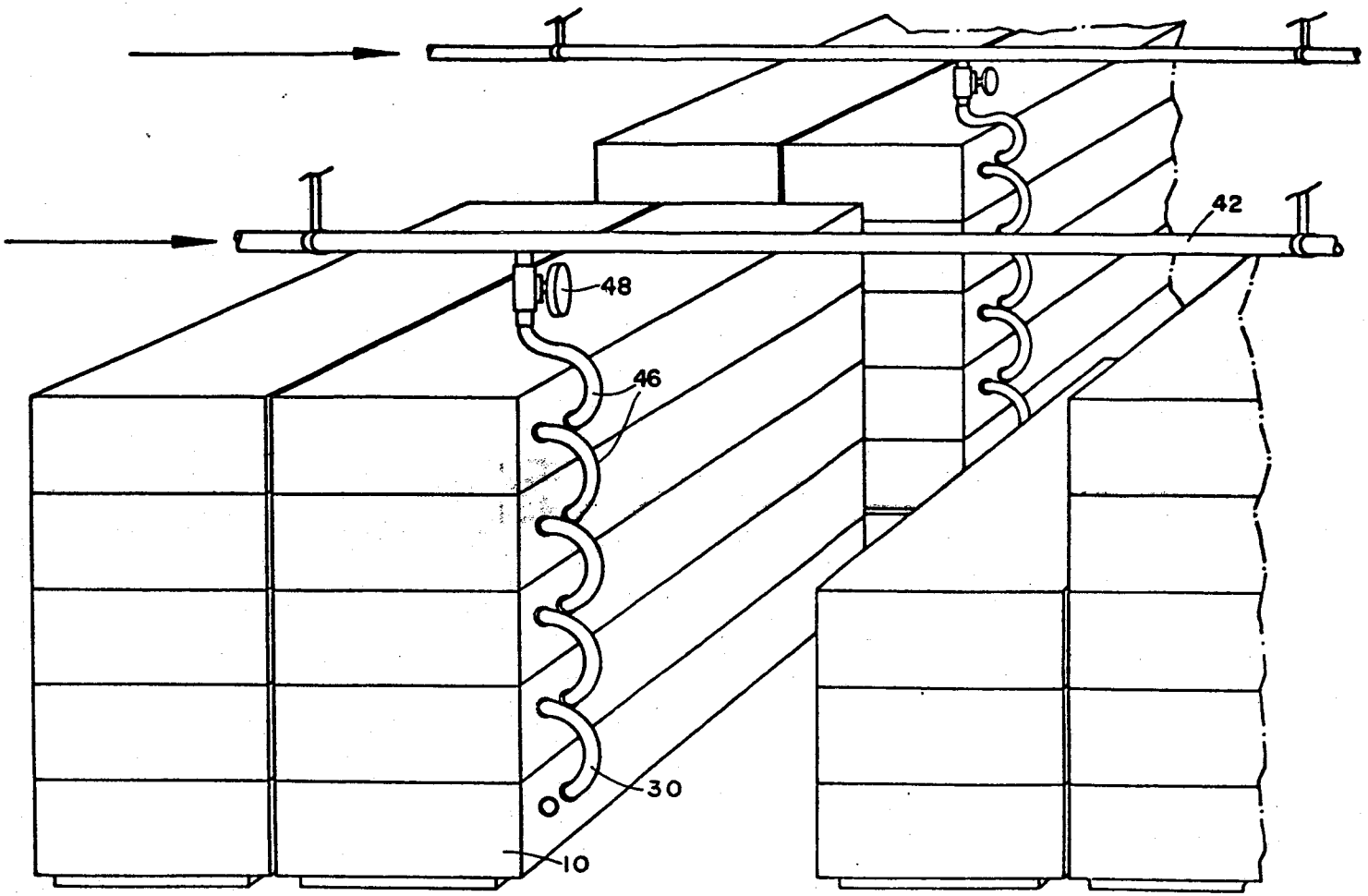
FIG. 3 is a pictorial view of a plurality of containers to be connected to a supply of an inert gas.

The invention will now be described with particular reference to the storage of hardware. This description is purely exemplary, it being understood that the container system shown could also be used for storage and/or transport of perishable goods.

Referring now to FIG. 1 there is shown a container body constructed and operative according to a preferred embodiment of the invention. Container body 10 comprises a generally rectangular body formed of a rectangular base 12 and upstanding side portions 14 which may conveniently be formed as a unit with base 12. In a preferred embodiment of the invention the interior of container 10 is configured to contain predetermined articles of hardware, or more particularly armaments in such a way as to simplify packaging and to prevent damage to the contents during handling and unpacking. The configuration of the interior of the container may conveniently be realized by moulding a plastic material to a predetermined desired shape.

As can be seen from FIG. 2 base 20 of the container body may conveniently be fabricated unitarily with the molded interior of the container. Depending on the configuration desired for the interior of the container, base 20 may be formed with a number of recesses 40 which enable substantial savings in material without sacrificing structural strength.

The container is preferably formed with a one-way valve of conventional construction which enables an inert atmosphere such as nitrogen to be introduced into the container under pressure but does not permit escape of the nitrogen. In an alternative embodiment of the invention a closable exhaust aperture 15 may also be provided to permit interconnection of a plurality of adjacently disposed sealed containers in a manner to be described hereinafter.

The container is sealed by a removable top 16 having a generally tapered lower edge 18 which sealingly fits within the peripheral top edge 20 of the container body. Additional resilient seals of rubber or any suitable material may also be employed to enhance the seal between the container body and top 14.

According to a preferred embodiment of the invention a closure member 24 engages top 16 at recess 22 and the bottom of the base for secure closing of the containers.

According to an alternative embodiment of the invention, parts of the base and cover may be configured in any suitable manner so as to provide substantially air-tight sealing.

According to a preferred embodiment of the invention the top 16 is configured with a plurality of recesses 22 which enable savings in material in construction and may also enhance the ease of stacking a number of containers one on top of the other.

An inert gas such as nitrogen may be conveniently supplied to the container through a retractable access hose 30 which extends to an aperture 32 in the container body. When not in extended position hose 30 is stored within a recess 34 on one side of the container. Valve 13 may be conveniently located within hose 30 or at either end thereof to provide sealing of the container.

According to a preferred embodiment of the invention, a plurality of containers may be stacked in adjacent rows as shown in FIG. 3. The containers are interconnected to a supply of nitrogen from a nitrogen supply line 42 through a valve 48 by hoses 46 which extend from the valve to a supply aperture 13 and between the exhaust aperture 15 and supply apertures 13 of adjacent stacked containers. When interconnected to a constant or periodic supply of inert gas, the contents of the containers may be stored indefinitely.

It will be clear to those skilled in the art from the above description written in conjunction with the drawings, that many different types of containers filled with any suitable inert gas may be constructed and operated in accordance with differing embodiments of the present invention. The present invention is not limited to those embodiments shown, described or suggested herein and is limited only by the scope of the claims which follow:

I claim:

1. A long-term storage system for connection to a continuous or intermittent supply of inert gas comprising:

a plurality of long-term, hermetically sealable individually transportable storage containers each storage container having first and second gas communication terminals communicating with the interior thereof;

selectably decouplable serial interconnection conduit means for serial coupling of respective first and second communication terminals of adjacent ones of said plurality of storage containers and for coupling said serially connected storage containers to a continuous or intermittent gas supply; and means for preventing egress of inert gas from individual ones of said containers when said individual ones of said containers are not coupled to a gas supply or to adjacent ones of said containers.

2. A long-term storage system according to claim 1 wherein said means for preventing egress comprises:

one way valve means preventing egress of inert gas from said storage containers through the respective first gas communication terminals; and means for selectably sealing said second communication terminals when said second terminals are not coupled to said conduit means.

3. A long-term storage system according to claim 1 wherein said storage containers are configured such that the interior thereof is molded to conform to the general configuration of goods to be stored therein.

4. A long-term storage system according to claim 1 and wherein said storage containers are configured to be stackable one upon another.

5. A long-term storage system according to claim 1 wherein said serial interconnection conduit means comprises a plurality of retractable access hoses each selectably storable in a recess formed in a respective one of said storage containers.

6. A long-term storage system according to claim 5 wherein said egress preventing means comprises one way valve means associated with said retractable access hose for preventing egress of gas from said long-term storage containers.

7. A long-term storage system comprising:

supply means for continuously or intermittently providing a flow of inert gas;

a plurality of long-term, hermetically sealed, individually transportable, storage containers; each storage container having first and second gas communication terminals communicating with the interior thereof;

selectably decouplable serial interconnection conduit means for serial coupling of respective first and second communication terminals of adjacent ones of said plurality of storage containers and for coupling said serially connected storage containers to said supply means;

one way valve means preventing egress of said inert gas from said storage containers through said respective first communication terminals; and means for selectably sealing said second communication terminal when said second terminals are not coupled to said conduit means; and wherein said conduit means comprise a plurality of retractable access hose means each associated with a storage container and selectably locatable within a recess thereof.

* * * * *